US011087681B2

(12) United States Patent
Park

(10) Patent No.: US 11,087,681 B2
(45) Date of Patent: Aug. 10, 2021

(54) DISPLAY DEVICE AND METHOD OF COMPENSATING PIXEL DEGRADATION OF THE SAME

(71) Applicant: SAMSUNG DISPLAY CO., LTD., Yongin-si (KR)

(72) Inventor: Jin-Woo Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/744,093

(22) Filed: Jan. 15, 2020

(65) Prior Publication Data

US 2020/0160785 A1 May 21, 2020

Related U.S. Application Data

(62) Division of application No. 15/234,981, filed on Aug. 11, 2016, now Pat. No. 10,559,254.

(30) Foreign Application Priority Data

Sep. 8, 2015 (KR) ..... 10-2015-0127246

(51) Int. Cl.
*G09G 3/3291* (2016.01)
*G09G 3/3258* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2320/0238* (2013.01); *G09G 2320/0295* (2013.01); *G09G 2320/043* (2013.01); *G09G 2320/045* (2013.01)

(58) Field of Classification Search
CPC ..... G09G 3/3233; G09G 2320/043; G09G 2320/0295; G09G 2300/0819; G09G 2300/0842; G09G 2300/0861; G09G 2320/0238; G09G 2320/045
See application file for complete search history.

(56) References Cited

U.S. PATENT DOCUMENTS

| | | | | |
|---|---|---|---|---|
| 7,885,478 | B2 * | 2/2011 | Lee | G06T 5/005 382/275 |
| 9,418,590 | B2 * | 8/2016 | Park | G09G 3/2092 |
| 2013/0050292 | A1 | 2/2013 | Mizukoshi | |
| 2013/0057595 | A1 | 3/2013 | Nathan et al. | |
| 2013/0147693 | A1 | 6/2013 | Bae | |
| 2014/0160142 | A1 | 6/2014 | Lee et al. | |
| 2015/0103106 | A1 * | 4/2015 | Chaji | G09G 3/3225 345/690 |
| 2016/0125811 | A1 | 5/2016 | Park et al. | |
| 2018/0068611 | A1 | 3/2018 | Chaji et al. | |

* cited by examiner

*Primary Examiner* — Kwang-Su Yang
(74) *Attorney, Agent, or Firm* — Lewis Roca Rothgerber Christie LLP

(57) ABSTRACT

A display device includes a display panel including a first pixel that emits light with a first luminance that is lower than target luminance and a second pixel that emits light with a second luminance that is higher than the target luminance, a sensor configured to measure a first characteristic of a first light emitting element in the first pixel and a second characteristic of a second light emitting element in the second pixel, and a data compensator configured to calculate a degradation amount of the second pixel based on the first characteristic and the second characteristic.

2 Claims, 7 Drawing Sheets

DISPLAY DEVICE AND METHOD OF COMPENSATING PIXEL DEGRADATION OF THE SAME

CROSS-REFERENCE TO RELATED APPLICATION

This application is a divisional of U.S. patent application Ser. No. 15/234,981, filed Aug. 11, 2016, which claims priority to and the benefit of Korean Patent Application No. 10-2015-0127246, filed Sep. 8, 2015, the entire content of both of which is incorporated herein by reference.

BACKGROUND

1. Field

Aspects of the present invention relate to a display device.

2. Description of the Related Art

An organic light emitting display device displays images using organic light emitting diodes. The organic light emitting diodes and driving transistors that transfer currents to the organic light emitting diodes may be degraded as the organic light emitting diodes and the driving transistors operate. The organic light emitting display device may not display images with desired luminance due to degradation of the organic light emitting diodes and degradation of the driving transistors (hereinafter, referred to as "pixel degradation").

A conventional organic light emitting display device provides a reference voltage to pixels, measures a current (i.e., a driving current) flowing through each of the pixels in response to the reference voltage, and calculates an amount of degradation of each of the pixels by comparing the measured current with a reference current that is measured at a dummy pixel. However, accuracy of the degradation amount may decrease as a distance between the pixel and the dummy pixel increases because current variation characteristics of the pixels differ according to locations (or positions) of the pixels. In addition, a viewer may observe the dummy pixel, which does not emit light, when the dummy pixel is adjacent to the pixel.

SUMMARY

Aspects of embodiments of the present invention are directed to an organic light emitting display device that is capable of accurately compensating for pixel degradation.

Aspects of embodiments of the present invention are directed to a method of compensating for pixel degradation of a display device.

According to some example embodiments of the present invention, there is provided a display device including: a display panel including a first pixel that emits light with a first luminance that is lower than target luminance and a second pixel that emits light with a second luminance that is higher than the target luminance; a sensor configured to measure a first characteristic of a first light emitting element in the first pixel and a second characteristic of a second light emitting element in the second pixel; and a data compensator configured to calculate a degradation amount of the second pixel based on the first characteristic and the second characteristic.

In an embodiment, the second pixel is adjacent to the first pixel, and a luminance difference between the target luminance and the first luminance is compensated based on the second luminance.

In an embodiment, the first characteristic is a first current that flows through the first light emitting element in response to a sensing voltage, and the second characteristic is a second current that flows through the second light emitting element in response to the sensing voltage.

In an embodiment, the display device further includes: a data driver configured to generate a first data voltage based on a target grayscale value to provide the first data voltage to the first pixel, and to generate a second data voltage based on the target grayscale value to provide the second data voltage to the second pixel, the target grayscale value corresponding to the target luminance.

In an embodiment, the display device further includes: an emission driver configured to generate a first light emission control signal based on a target grayscale value to provide the first light emission control signal to the first pixel, and to generate a second light emission control signal based on the target grayscale value to provide the second light emission control signal to the second pixel, the target grayscale value corresponding to the target luminance.

In an embodiment, the data compensator is further configured to convert a target grayscale value corresponding to the target luminance into a first grayscale value corresponding to the first luminance, and to convert the target grayscale value into a second grayscale value corresponding to the second luminance.

In an embodiment, the first pixel is degraded by an aging process.

In an embodiment, the data compensator is further configured to calculate a characteristic difference between the second characteristic and the first characteristic, and to calculate the degradation amount of the second pixel based on the characteristic difference.

In an embodiment, the data compensator is further configured to compensate for the characteristic difference based on an initial characteristic difference of the second pixel, and to calculate the degradation amount using a linear equation representing a relation between a compensated characteristic difference and the degradation amount of the second pixel.

In an embodiment, the data compensator is further configured to compensate input data based on the degradation amount of the second pixel.

In an embodiment, the data compensator is further configured to receive a first measured luminance corresponding to the first characteristic and a second measured luminance corresponding to the second characteristic from a luminance measuring device, and to generate a degradation compensation model based on the first characteristic, the second characteristic, the first measured luminance, and the second measured luminance, wherein the degradation compensation model represents a relation between a characteristic variation and a luminance variation, wherein the characteristic variation is a characteristic difference between the first characteristic and the second characteristic, and wherein the luminance variation is a luminance difference between the first measured luminance and the second measured luminance.

In an embodiment, the data compensator is further configured to calculate an initial characteristic difference of the second pixel based on the first characteristic and the second characteristic, and to store the initial characteristic difference in a memory device.

According to some example embodiments of the present invention, there is provided a method of compensating for pixel degradation of a display device that includes a first pixel that emits light with a first luminance that is lower than target luminance and a second pixel that emits light with a second luminance that is higher than the target luminance, the method including: measuring a first characteristic of a first light emitting element included in the first pixel and a second characteristic of a second light emitting element included in the second pixel; receiving a first measured luminance corresponding to the first characteristic and a second measured luminance corresponding to the second characteristic from an external component; and generating a degradation compensation model based on the first characteristic, the second characteristic, the first measured luminance, and the second measured luminance, wherein the degradation compensation model represents a relation between a characteristic variation and a luminance variation, the characteristic variation being a characteristic difference between the first characteristic and the second characteristic, and the luminance variation being a luminance difference between the first measured luminance and the second measured luminance.

In an embodiment, generating the degradation compensation model includes: calculating an initial characteristic difference of the second pixel based on the first characteristic and the second characteristic; and storing the initial characteristic difference in a memory device.

According to some example embodiments of the present invention, there is provided a method of compensating pixel degradation of a display device including a first pixel that emits light with a first luminance that is lower than target luminance and a second pixel that emits light with a second luminance that is higher than the target luminance, the method including: measuring a first characteristic of a first light emitting element in the first pixel and a second characteristic of a second light emitting element in the second pixel; and calculating a degradation amount of the second pixel based on the first characteristic and the second characteristic.

In an embodiment, the second pixel is adjacent to the first pixel, and a luminance difference between the target luminance and the first luminance are compensated based on the second luminance.

In an embodiment, the first characteristic is a first current that flows through the first light emitting element in response to a sensing voltage, and the second characteristic is a second current that flows through the second light emitting element in response to the sensing voltage.

In an embodiment, calculating the degradation amount of the second pixel includes: calculating a characteristic difference between the first characteristic and the second characteristic; and calculating the degradation amount of the second pixel based on the characteristic difference.

In an embodiment, calculating the degradation amount of the second pixel based on the characteristic difference includes: compensating for the characteristic difference based on an initial characteristic difference of the second pixel; and calculating the degradation amount of the second pixel using a linear equation representing a relation between a compensated characteristic difference and the degradation amount of the second pixel.

In an embodiment, the method further includes: compensating input data based on the degradation amount of the second pixel.

Therefore, a display device according to some example embodiments may improve accuracy of compensating for pixel degradation by calculating an amount of degradation of a second pixel, which is adjacent to a first pixel, based on the first pixel, which emits light with luminance that is lower than a target luminance (i.e., the first pixel is less degraded, or degraded slower, than the second pixel).

In addition, the display device may prevent or substantially prevent an image quality from being degraded by compensating the luminance of the first pixel (i.e., a pixel having a luminance lower than the target luminance) with the luminance of the second pixel (i.e., a pixel having a luminance higher than the target luminance).

Furthermore, a method of compensating for pixel degradation of a display device according to some example embodiments may efficiently compensate for the pixel degradation of the display device.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in detail with reference to the accompanying drawings.

Figure 1:
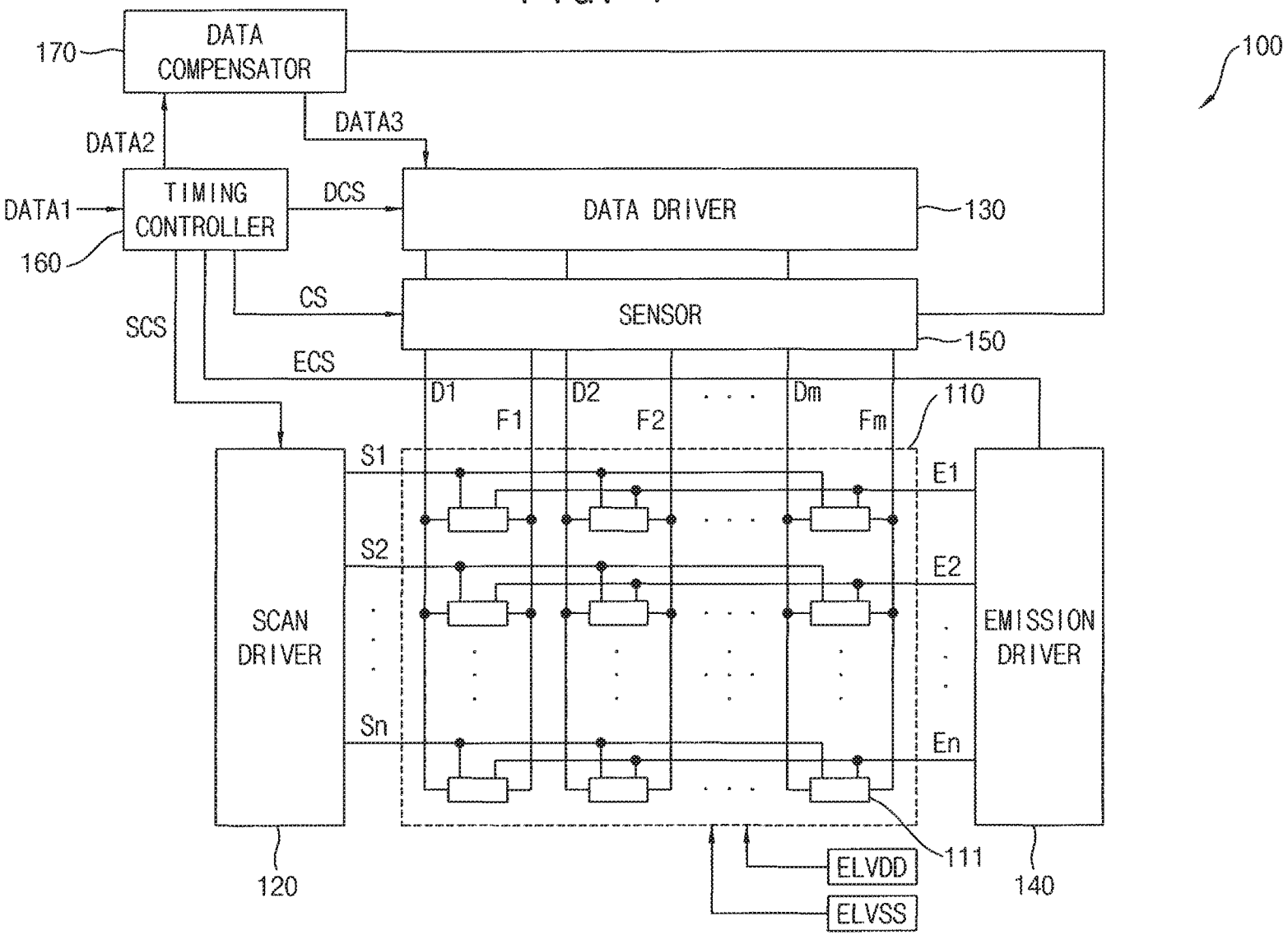
FIG. 1 is a block diagram illustrating a display device according to some example embodiments of the present invention.

FIG. 1 is a block diagram illustrating a display device according to some example embodiments of the present invention.

Referring to FIG. 1, the display device 100 may include a display panel 110, a scan driver 120, a data driver 130, an emission driver 140, a sensor 150, a timing controller 160, and a data compensator 170. The display device 100 may display an image based on image data (e.g., a first data DATA1) provided by an external component. For example, the display device 100 may be an organic light emitting display device.

The display panel 110 may include scan lines S1 through Sn, data lines D1 through Dm, light emitting control lines E1 through En, feedback lines F1 through Fm, and pixels 111, where each of m and n is an integer greater than or equal to 2. The pixels 111 may be respectively disposed in cross-regions of the scan lines S1 through Sn, the data lines D1 through Dm, the light emitting control lines E1 through En, and the feedback lines F1 through Fm.

Each of the pixels 111 may store a data signal in response to a scan signal, and may emit light based on a stored data signal. A configuration of the pixels 111 will be described in further detail with reference to FIG. 5.

In some example embodiments, the display panel 10 may include a first pixel (or, a reference pixel), which emits light with first luminance that is lower than target luminance, and a second pixel (or, an adjacent pixel), which emits light with second luminance that is higher than the target luminance. Here, the target luminance may be luminance with which a reference pixel emits light in response to certain data. In an example embodiment, the second pixel may be adjacent to the first pixel and may compensate for a luminance difference between the target luminance and the first luminance by emitting light with the second luminance. That is, the second pixel may compensate for a luminance (or a brightness) deficiency (e.g., a difference between the target luminance and the first luminance). A configuration of the first pixel and the second pixel will be described in detail with reference to FIG. 3A.

The scan driver 120 may generate the scan signal based on a scan driving control signal SCS. The scan driving control signal SCS may be provided from the timing controller 160 to the scan driver 120. The scan driving control signal SCS may include a start pulse and clock signals, and the scan driver 120 may include a shift register for sequentially generating the scan signal based on the start pulse and the clock signals.

The data driver 130 may generate data signals based on a data driving control signal DCS and image data (e.g., a third data DATA3). The data driver 130 may provide the display panel 110 with the data signals generated in response to the data driving control signal DCS. That is, the data driver 130 may provide the data signals to the pixels 111 through the data lines D1 through Dm. The data driving control signal DCS may be provided from the timing controller 160 to the data driver 130. The image data may be provided from the data compensator 170 or the timing controller 160 to the data driver 130.

In some example embodiments, the data driver 130 may generate a first data voltage based on a first grayscale value corresponding to the target luminance, may provide the first data voltage to the first pixel, may generate a second data voltage based on the target grayscale value, and may provide the second data voltage to the second pixel. For example, the data driver 130 may generate the first data voltage and the second data voltage using a gamma voltage generating unit (e.g., a gamma voltage generator). Therefore, the first pixel may emit light with the first luminance based on the first data voltage, and the second pixel may emit light with the second luminance based on the second data voltage.

The emission driver 140 may generate a light emission control signal based on a light emission driving control signal ECS. The light emission driving control signal ECS may be provided from the timing controller 160 to the emission driver 140. The emission driver 140 may generate the light emission control signal based on the light emission driving control signal ECS and clock signals, concurrently (e.g., simultaneously) or sequentially.

In some example embodiments, the emission driver 140 may generate a first light emission control signal based on a target grayscale value corresponding to the target luminance, may provide the first light emission control signal to the first pixel, may generate a second light emission control signal based on a target grayscale value corresponding to the target luminance, and may provide the second light emission control signal to the second pixel. Therefore, the first pixel may emit light with the first luminance based on the first light emission control signal, and the second pixel may emit light with the second luminance based on the second light emission control signal.

The sensor 150 may be connected to the feedback lines F1 through Fm and may measure (or, detect, sense) a characteristic of a pixel 111 based on a control signal CS. Here, the control signal CS may be provided from the timing controller 160 to the sensor 150. The characteristic of the pixel 111 may be a characteristic of a light emitting element included in the pixel 111, and the characteristic of the pixel 111 may include at least one among a current-voltage characteristic of the light emitting element, a voltage-luminance characteristic of the light emitting element, and an impedance characteristic (or, an resistance characteristic, a capacitance characteristic) of the light emitting element, where the impedance may include a resistance and a capacitance (e.g., a parasitic capacitance of the light emitting element). For example, when a certain voltage (e.g., a sensing voltage) is provided to the pixel 111, the characteristic of the pixel 111 may be represented as a current (or, an amount of a current) that flows through the light emitting element included in the pixel 111. Hereinafter, the characteristic of the pixel 111 is assumed to be a current-voltage characteristic of the light emitting element and to be an amount of a current (or, an amount of a driving current) that flows through the light emitting element in response to a sensing voltage.

In some example embodiments, the sensor 150 may provide a reference voltage (or, a sensing voltage) to a certain feedback line (e.g., an (m)th feedback line Fm) in response to the control signal CS, and may measure a driving current of the pixel 111 by integrating a current that is returned through the feedback line in response to the reference voltage. Here, the reference voltage may be greater than a threshold voltage of the light emitting element (e.g., an organic light emitting diode). A configuration of the sensor 150 and a configuration for measuring the characteristic (e.g., a driving current flowing through the light emitting element) of the pixel 111 will be described in detail with reference to FIG. 5.

The timing controller 160 may control the scan driver 120, the data driver 130, the emission driver 140, sensor 150, and the data compensator 170. The timing controller 160 may generate the scan driving control signal SCS, the data driving control signal DCS, the light emission driving control signal ECS, and the control signal CS, and may control the scan driver 120, the data driver 130, the emission driver 140, the sensor 150, and the data compensator 170 based on the generated signals.

The data compensator 170 may calculate a degradation amount of a pixel based on a characteristic of the pixel. In some example embodiments, the data compensator 170 may calculate a degradation amount (a relative degradation amount) of the second pixel based on a characteristic of the first pixel and a characteristic of the second pixel. For example, the data compensator 170 may calculate a current difference between a first current of the first pixel and a second current of the second pixel, and may calculate the degradation amount of the second pixel based on the current difference. For example, the data compensator 170 may calculate the degradation amount of the second pixel using a degradation curve or a linear equation, where the degradation curve or the linear equation may include a relation between the current difference and the degradation amount.

In some example embodiments, the data compensator 170 may compensate input data (i.e., input data corresponding to the second pixel, such as second data DATA2) based on the degradation amount of the second pixel. For example, the data compensator 170 may obtain compensation data corresponding to the degradation amount of the second pixel using a look-up table and may generate the third data DATA3 by adding (or, summing) the second data DATA2 with the compensation data, where the look-up table may include the compensation data corresponding to the degradation amount.

In some example embodiments, the data compensator 170 may convert the target grayscale value (i.e., the target grayscale value corresponding to the target luminance) into a first grayscale value corresponding to the first luminance and may convert the target grayscale value into a second grayscale value corresponding to the second luminance. In this case, the first pixel may emit light with the first luminance based on the first grayscale value, and the second pixel may emit light with the second luminance based on the second grayscale value. A configuration of the data compensator 170 will be described in detail with reference to FIG. 6.

The display device 100 may further include a power supplier. The power supplier may generate a driving voltage to drive the display device 100. The driving voltage may include a first power voltage ELVDD and a second power voltage ELVSS. The first power voltage ELVDD may be greater (or, higher) than the second power voltage ELVSS.

As described above, the display device 100 may calculate the degradation amount (a relative degradation amount) of the second pixel adjacent to the first pixel based on the first pixel, which emits light with the luminance that is lower than the target luminance. That is, the display device 100 may calculate a relative degradation amount of the second pixel using the first pixel adjacent to the second pixel. Therefore, accuracy of compensating for degradation of the second pixel may be improved. In addition, the display device 100 may compensate for a luminance deficiency (e.g., a luminance difference between the target luminance and the first luminance) of the first pixel by emitting the second pixel with the second luminance that is higher than the target luminance. Therefore, the display device 100 may prevent or substantially prevent the first pixel from being visible to a user.

In FIG. 1, it is illustrated that the display panel 110 includes the feedback lines F1 through Fm and the sensor 150 is connected to the feedback lines F1 through Fm. However, the display panel 110 is not limited thereto. For example, the display panel 110 does not include the feedback lines F1 through Fm, and may use the data lines D1 through Dm as the feedback lines F1 through Fm by time-division driving of the data lines D1 through Dm.

It is illustrated that the data compensator 170 is included independently in FIG. 1. However, the data compensator 170 is not limited thereto. For example, the data compensator 170 may be included in the timing controller 160 or a driving integrated circuit (i.e., an integrated circuit including at least one among the scan driver 120, the data driver 130, and the emission driver 140).

Figure 2A:
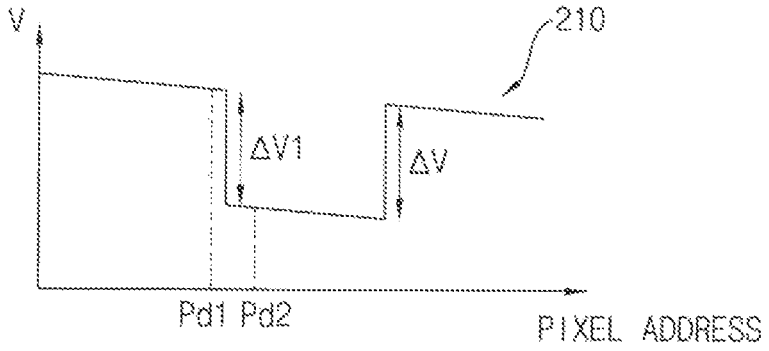
FIGS. 2A-2C are diagrams illustrating an example in which pixel degradation is compensated by the display device of FIG. 1.
Figure 2B:
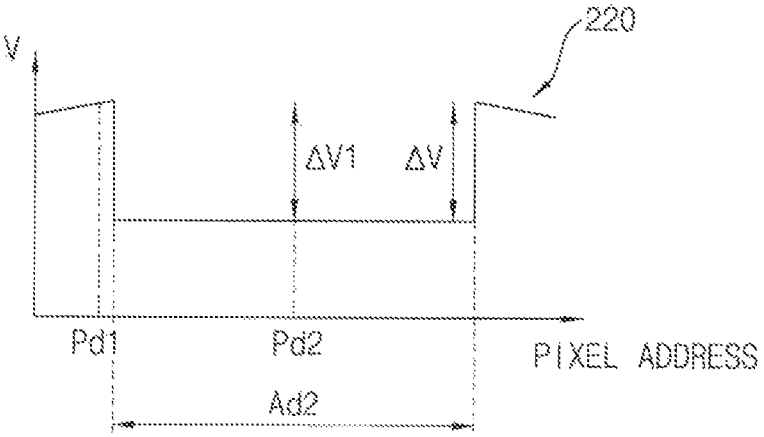
Figure 2C:
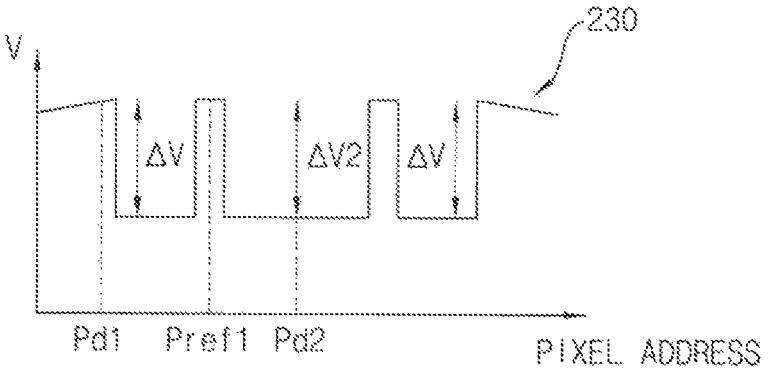

FIGS. 2A-2C are diagrams illustrating an example in which pixel degradation is compensated by the display device of FIG. 1.

Referring to FIGS. 1 and 2A-2C, sensing data of the pixels 111 (e.g., amounts of driving currents of the pixels 111 measured by the sensor 150) included the display device are illustrated.

A first measured data 210 may include a first measured voltage of a first degraded pixel Pd1 and a second measured voltage of a second degraded pixel Pd2. The first measured voltage may be generated by integrating a first driving current, which flows through a light emitting element of the first degraded pixel Pd1 when a sensing voltage is provided to the first degraded pixel Pd1, during a certain time. The second measured voltage may be generated by integrating a second driving current, which flows through a light emitting element of the second degraded pixel Pd2 when a sensing voltage is provided to the second degraded pixel Pd2, during a certain time. Because a degradation amount of the second degraded pixel Pd2 is greater than a degradation amount of the first degraded pixel Pd1, the second measured voltage is lower than the first measured voltage by a first voltage difference ΔV1. Here, the display device 100 may compensate data of the second degraded pixel Pd2 (e.g., data provided to the second degraded pixel Pd2) based on the first voltage difference ΔV1. According to the compensated data, the second degraded pixel Pd2 may have a driving current that is substantially the same as a current of the first degraded pixel Pd1, and the second degraded pixel Pd2 may emit light with luminance that is substantially the same as the luminance of the first degraded pixel Pd1. That is, the display device 100 may compensate for degradation of the second degraded pixel Pd2 based on the first degraded pixel Pd1, which is less degraded than the second degraded pixel Pd2.

However, as illustrated in a second measure data 220, when the second degraded pixel Pd2 is spaced apart from the first degraded pixel Pd1 (or, when a degradation area Ad2 in which a pixel is more degraded is large), there is no pixel, which is less degraded than the second degraded pixel Pd2, adjacent to the second degraded pixel Pd2. Therefore, the display device 100 may not calculate the first voltage difference ΔV1. In addition, when the display device 100 calculates a degradation amount of the second degraded pixel Pd2 based on data of the first degraded pixel Pd1 included in the second measure data 220, the degradation amount may be inaccurate. Because a characteristic of the pixels 111 may have a deviation according to an area of the display panel 110, compensating pixel degradation may be inaccurate.

As illustrated by a third measure data 230 of FIG. 2C, the display device 100 according to some example embodiments may include a reference pixel Pref1, which is a basis of compensating pixel degradation, in a degradation area Ad2, and the display device 100 (or, the method of compensating pixel degradation operated by the display device 100) may calculate a second voltage difference ΔV2 of the second degraded pixel Pd2 based on the reference pixel Pref1. Here, the reference pixel Pref1 may have a degradation speed (or, a degradation rate) which is relatively lower than a degradation speed (or, a degradation rate) of the second degraded pixel Pd2. That is, the display device 100 may calculate a degradation amount of the second degraded pixel Pd2 based on the reference pixel Pref1 adjacent to the second degraded pixel Pd2. Therefore, accuracy of compensating pixel degradation may be improved.

When degradation of the reference pixel is slowed (e.g., no data voltage is provided to the reference pixel Pref1), the reference pixel Pref1 may be visible to a user. However, the display device 100 may prevent or substantially prevent the reference pixel from being shown or being readily visible to a user by using pixels (e.g., by increasing luminance of pixels) adjacent to the reference pixel Pref1.

Figure 3A:
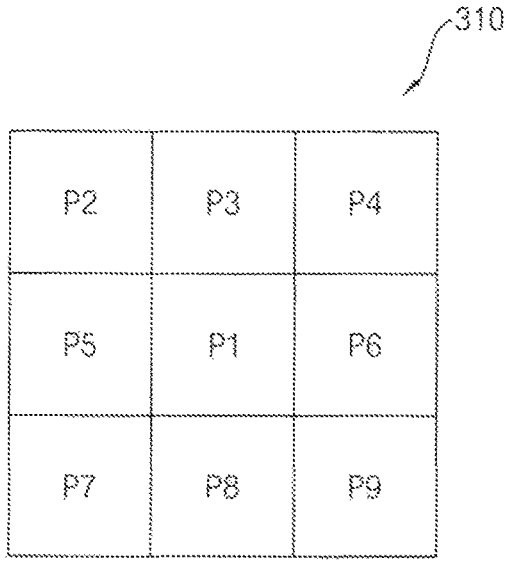
FIG. 3A is a diagram illustrating an example of a display panel included in the display device of FIG. 1.
Figure 3B:
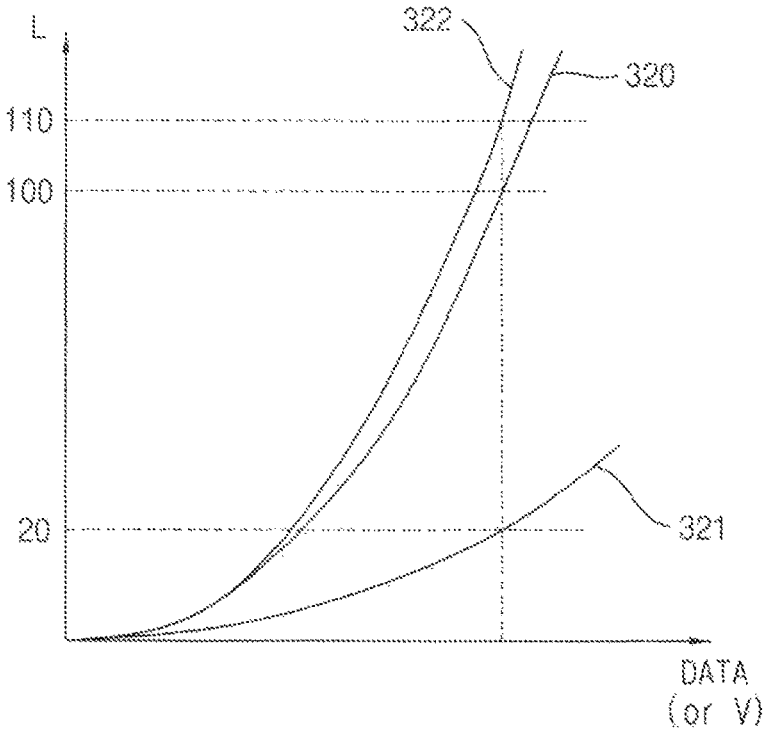
FIG. 3B is a diagram illustrating an example of a data-luminance curve of a pixel included in the display panel of FIG. 3A.
Figure 3C:
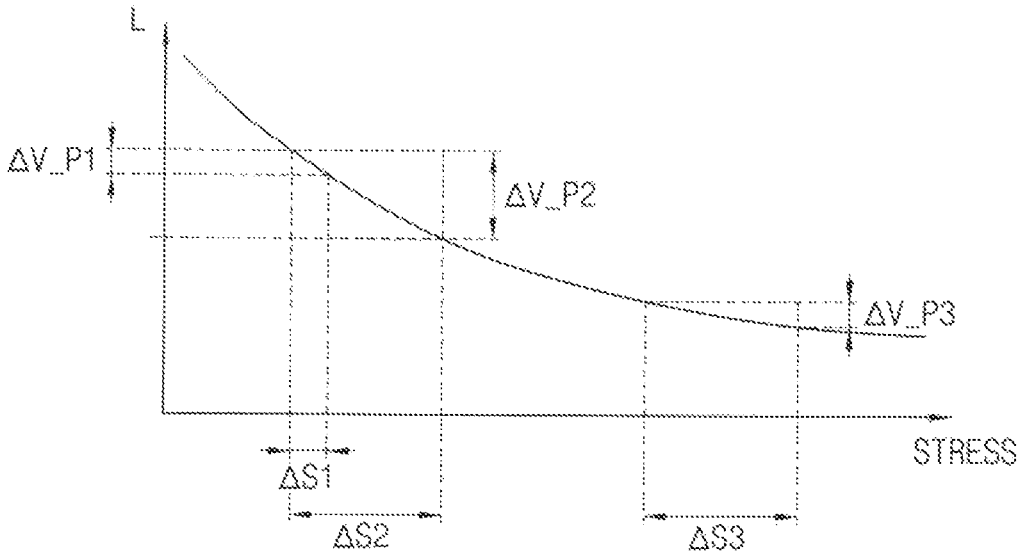
FIG. 3C is a diagram illustrating an example of a degradation curve of a pixel included in the display panel of FIG. 3A.

FIG. 3A is a diagram illustrating an example of a display panel included in the display device of FIG. 1. FIG. 3B is a diagram illustrating an example of a data-luminance curve of a pixel included in the display panel of FIG. 3A. FIG. 3C is a diagram illustrating an example of a degradation curve of a pixel included in the display panel of FIG. 3A.

Referring to FIG. 3A, the display panel 310 may include first through ninth pixels P1 through P9. The first pixel P1 may be a reference pixel described with reference to FIGS. 2A-2C, and the second through ninth pixels P2 through P9 may be adjacent pixels described with reference to FIGS. 2A-2C.

As illustrated in FIG. 3B, when a same data voltage is applied to the first through ninth pixels P1 through P9, the first pixel P1 may emit light with first luminance that is lower than target luminance, and the second through ninth pixels P2 through P9 may emit light with second luminance that is higher than the target luminance. Because the first pixel P1 emits light with the first luminance, degradation of the first pixel P1 may be relatively slow. The second through ninth pixels P2 through P9 may compensate for a luminance deficiency of the first pixel P1 by emitting light with the second luminance.

For example, the first pixel P1 may emit light with the first luminance which is 20 percent (%) of display luminance (or, the target luminance) according to a first emission curve 321 (or, a data voltage-luminance curve), and the second through ninth pixels P2 through P9 may emit light with the second luminance, which is 110 percent (%) of the display luminance, according to a second emission curve 322. Here, average luminance of the first through ninth pixel P1 through P9 may be substantially the same as the display luminance (i.e., the average luminance=(20%+110%*8)/9=100%). That is, a first area which includes the first through ninth pixels P1 through P9 may emit light with the display luminance according to a reference emission curve 320. Therefore, the second through ninth pixels P2 through P9 may compensate for a luminance deficiency (e.g., of about 80 percent (%)) of the first pixel P1 by emitting light with the second luminance and may prevent or substantially prevent the first pixel P1 from being shown or being readily visible.

In an example embodiment, the first pixel P1 may be surrounded by the second through ninth pixels P2 through P9. For example, the first pixel P1 may be located at a center of a certain area, the second through ninth pixels P2 through P9 may be located adjacent to the first pixel P1 around the first pixel P1. Here, the second through ninth pixels P2 through P9 may compensate for a luminance deficiency of the first pixel P1 with a relatively small increase in luminance (of, e.g., a difference between the second luminance and the target luminance).

In an example embodiment, the display device 100 may generate a first data voltage based on a target grayscale value according to the target luminance, may provide the first data voltage to the first pixel P1, may generate a second data voltage based on the target grayscale value, and may provide the second data voltage to the second pixel P2 (and, the third through ninth pixels P3 through P9). Here, the first data voltage may be lower than a target data voltage (or, a reference data voltage) corresponding to the target grayscale value, and the second data voltage may be higher than the target data voltage. For example, the display device 100 may include a first gamma voltage generating unit (e.g., a first gamma voltage generator) and a second gamma voltage generating unit (e.g., a second gamma voltage generator), may generate the first data voltage using the first gamma voltage generating unit, and may generate the second data voltage using the second gamma voltage generating unit. Here, the first gamma voltage generating unit and the second gamma voltage generating unit may have a same string of gamma resistors and may receive high (e.g., maximum) voltages, which are different from each other, from an external component.

In this case, as illustrated in FIG. 3C, the first stress ΔS1 (or, a change of stress) of the first pixel P1 may be less than the second stress ΔS2 of the second pixel P2. Therefore, a characteristic change (e.g., a first voltage variation ΔV_P1) of the first pixel P1 may be less than a characteristic change (e.g., a second voltage variation ΔV_P2) of the second pixel P2. That is, degradation of the first pixel P1 may be slower than degradation of the second pixel P2.

In an example embodiment, the display device 100 may generate a first light emission control signal based on the target grayscale value, may provide the first light emission control signal to the first pixel P1, may generate a second light emission control signal based on the target grayscale value, and may provide the second light emission control signal to the second pixel P2. Here, an off-duty ratio of the first light emission control signal may be greater than an off-duty ratio of a reference light emission control signal, which corresponds to the target grayscale value. That is, a non-emission time of the first pixel P1 may be relatively increased. In addition, an off-duty ratio of the second light emission control signal may be less than an off-duty ratio of the reference light emission control signal, which corresponds to the target grayscale value. That is, a non-emission time of the second pixel P2 may be relatively reduced.

In an example embodiment, the display device 100 may convert the target grayscale value into a first grayscale value corresponding to the first luminance, and may convert the target grayscale value into a second grayscale value corresponding to the second luminance. Here, the first grayscale value may be less than the target grayscale value, and the second grayscale value may be greater than the target grayscale value.

In an example embodiment, the display device 100 may have a different aging condition during a manufacturing process of the display device 100. For example, the first pixel P1 may be degraded more than the second pixel P2 by an aging process, where the aging process drives the display device 100 with a certain image for some period(s) to ensure reliability of the display device 100.

Here, as illustrated in FIG. 3C, third stress ΔS3 (or, a change of stress) of the first pixel P1 may be substantially the same as second stress ΔS2 of the second pixel P2, but a characteristic change (e.g., a third voltage variation ΔV_P3) of the first pixel P1 may be less than a characteristic change (e.g., a second voltage variation ΔV_P2) of the second pixel P2. That is, when the first pixel P1 is degraded in initial time (or, during an aging process), degradation of the first pixel P1 may be slower than degradation of the second pixel P2.

As described above, the display device 100 according to some example embodiments may include the first pixel P1, which emits light with the first luminance that is lower than the target luminance, and the second pixel P2 (and, the third through ninth pixels P3 through P9), which emits light with the second luminance that is higher than the target luminance. Therefore, degradation of the first pixel P1 may be slower because the first pixel P1 emits light with the first luminance. In addition, by compensating for a luminance deficiency of the first luminance with the second luminance, the first pixel P1 may not be readily visible to a user.

Figure 4:
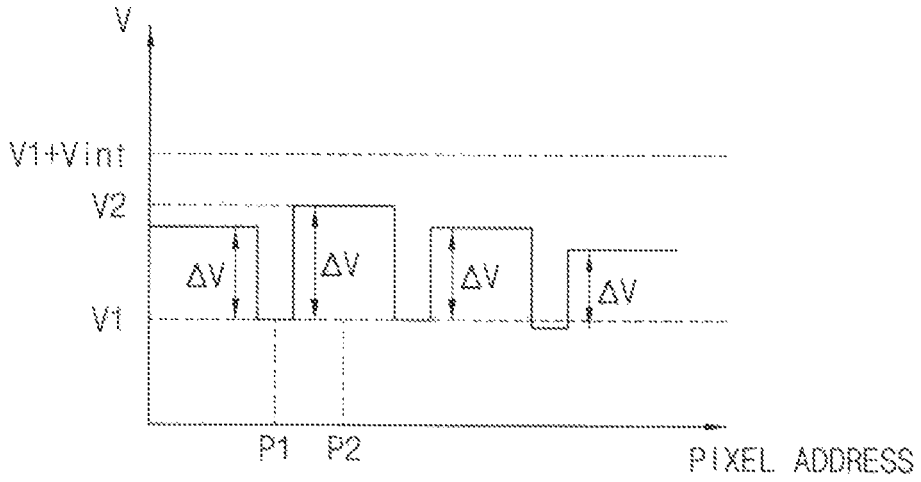
FIG. 4 is a diagram illustrating an example in which pixel degradation is compensated by the display device of FIG. 1.

FIG. 4 is a diagram illustrating an example in which pixel degradation is compensated by the display device of FIG. 1.

Referring to FIGS. 3A and 4, the first pixel P1 illustrated in FIG. 4 may be degraded more than the second pixel P2 during a manufacturing process (or, an aging process) as described with reference to FIG. 3C. Here, immediately after an aging process, a first initial characteristic (e.g., a first initial driving current) of the first pixel P1 according to a sensing voltage may be lower, by an initial characteristic difference Vint, than a second initial characteristic (e.g., a second initial driving current) of the second pixel P2. Therefore, the display device 100 may calculate a voltage difference ΔV based on the first characteristic V1 of the first pixel P1 and the second characteristic Δ2 of the second pixel P2, but may compensate for the voltage difference ΔV using the initial characteristic difference Vint (i.e., by using Vint−ΔV), and may calculate a degradation amount of the second pixel P2 based on a compensated voltage difference. That is, the display device 100 may calculate a degradation amount of the second pixel P2 with respect to a sum of the first characteristic V1 and the initial characteristic difference Vint (i.e., V1+Vint) considering the initial characteristic difference Vint between the first pixel P1 and the second pixel P2.

Figure 5:
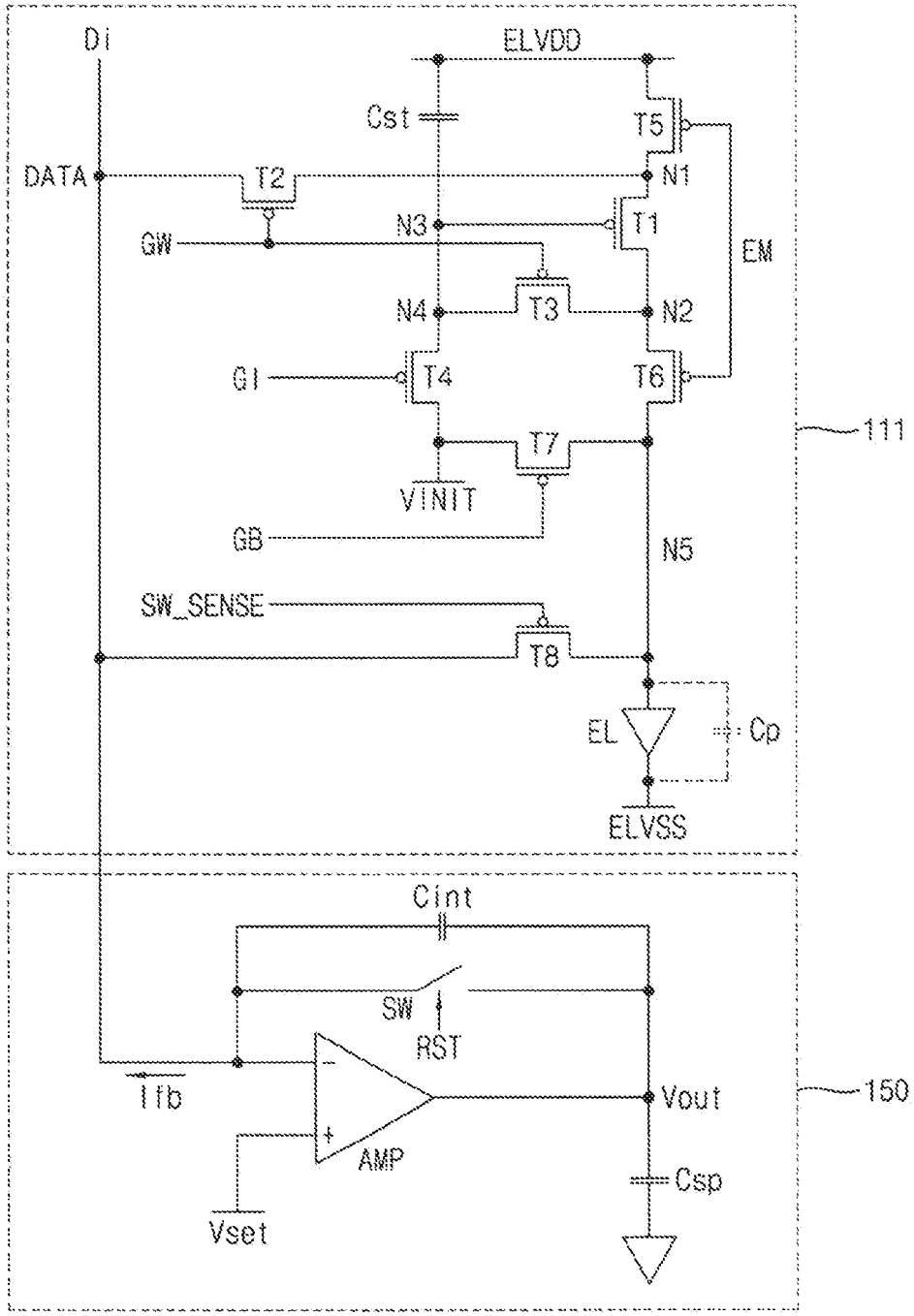
FIG. 5 is a circuit diagram illustrating examples of a pixel and a sensor included in the display device of FIG. 1.

FIG. 5 is a circuit diagram illustrating examples of a pixel and a sensor included in the display device of FIG. 1.

Referring to FIG. 5, the pixel 111 may have a structure of 8T1C (i.e., eight transistors and one capacitor). The pixel 111 may include first through eighth transistors T1 through T8, a storage capacitor Cst, and an organic light emitting diode EL. The pixel 111 may be electrically connected to the sensor 150 through a data line Di (or, a feedback line).

The first transistor T1 (or, a driving transistor) may be electrically connected between the high power voltage ELVDD (or, a first node N1) and the organic light emitting diode EL (or, a second node N2) and may be turned on in response to a first node voltage of a third node N3. The second transistor T2 (or, a switching transistor) may be electrically connected between the data line Di and the first node N1 and may be turned on in response to a first scan signal GW (or, a first gate signal). The third transistor T3 may be electrically connected between the second node N2 and a third node N3 and may be turned on in response to the first scan signal GW. That is, the second transistor T2 and the third transistor T3 may transfer a data signal DATA to the third node N3 in response to the first scan signal GW. The storage capacitor Cst may be electrically connected between the high power voltage ELVDD and the third node N3 and may store the data signal provided to the third node N3.

The fourth transistor T4 may be electrically connected between the third node N3 and an initialization voltage VINIT and may be turned on in response to a second scan signal GI (or, a second gate signal). Here, the storage capacitor Cst may be initialized to have the initialization voltage VINIT. The fifth transistor T5 may be electrically connected between the high power voltage and the first node N1 and may be turned on in response to a light emission control signal EM. The sixth transistor T6 may be electrically connected between the second node N2 and a fifth node N5 and may be turned on in response to the light emission control signal EM. That is, the fifth transistor T5 and the sixth transistor T6 may form a current flow path from the high power voltage ELVDD to the organic light emitting diode EL in response to the light emission control signal EM. The organic light emitting diode EL may be electrically connected between the fifth node N5 and the low power voltage ELVSS. That is, an anode of the organic light emitting diode EL may be electrically connected to the fifth node N5, and a cathode of the organic light emitting diode EL may be electrically connected to the low power voltage ELVSS. The organic light emitting diode EL may emit light based on a current (e.g., a driving current) that flows through the first transistor T1. The organic light emitting diode EL may include capacitance, where the capacitance may be represented as a parasitic capacitor Cp electrically connected in parallel to the organic light emitting diode EL as illustrated in FIG. 5.

The seventh transistor T7 may be electrically connected between the initialization voltage VINIT and the fifth node N5 and may be turned on in response to a third scan signal GB. That is, the seventh transistor T7 may form a bypass path between the fifth node N5 and the initialization voltage VINIT in response to the third scan signal GB.

The eighth transistor T8 may be electrically between the fifth node N5 and the data line Di and may be turned on in response to a sensing control signal SW_sense. That is, the eighth transistor T8 may be electrically connected between the anode of the organic light emitting diode EL and the data line Di and may diode-couple the anode of the organic light emitting diode EL with the data line Di in response to the sensing control signal SW_sense. Here, the sensing control signal SW_sense may be provided from the sensor 150 (or, the timing controller 160) to the eighth transistor T8.

The pixel 111 shown in FIG. 5 is illustrative of an example embodiment of the present invention. However, the pixel 111 is not limited thereto. For example, the pixel 111 may have a 4T1C structure (i.e., a structure including four transistors and one capacitor). For example, the pixel 111 may include a feedback line that is different from (or, independent from) the data line Di, and the eighth transistor T8 may be electrically connected between the feedback line and the organic light emitting diode. In addition, each of the first through eighth transistors T1 through T8 shown in FIG. 5 is a P-type transistor; however, the first through eighth transistors T1 through T8 are not limited thereto. For example, each of the first through eighth transistors T1 through T8 may be an N-type transistor.

The sensor 150 may include an amplifier AMP, an integrating capacitor Cint, and a switch SW. The amplifier AMP may include a first input terminal electrically connected to the data line Di (or, a feedback line), a second input terminal receiving a reference voltage Vset, and an output terminal. The integrating capacitor Cint may be electrically connected between the first input terminal of the amplifier AMP and the output terminal of the amplifier AMP. When the eighth transistor is turned on, a current flow path may be formed from the amplifier AMP to the organic light emitting diode through the data line Di. Here, a feedback current Ifb may flow from the output terminal of the amplifier AMP through the integrating capacitor Cint and the data line Di according to the reference voltage Vset, and the integrating capacitor Cint may integrate the feedback current Ifb. The sensor 150 may temporally store an integrated feedback current (e.g., a corresponding measured voltage Vout) using a sampling capacitor Csp.

The sensor 150 may generate information corresponding to (or including) an impedance of the pixel 111 or information corresponding to (or including) a driving current of the pixel 111 based on the measured voltage Vout, or may provide the measured voltage Vout to the timing controller 160. For example, the sensor 150 may process the measured voltage Vout using a comparator, an analog-to-digital convertor (ADC) and may output a processed measured voltage Vout as the information corresponding to the impedance of the pixel 111 or as the information corresponding to the driving current of the pixel 111. For example, the sensor 150 may provide the measured voltage Vout to the timing controller 160, and the timing controller 160 may generate the information corresponding to the impedance of the pixel 111 or the driving current of the pixel 111 by processing the measured voltage Vout.

The switch SW may be electrically connected in parallel to the integrating capacitor Cst and may be turned off (or, turned on) in response to a switch control signal RST. When the switch SW is turned on, the feedback current Ifb may flow through a current flow path that is formed by the switch SW. Therefore, a voltage across the integrating capacitor Cint may be 0 volt (V), and the integrating capacitor Cint may be discharged (or, be initialized).

As described above, the sensor 150 may provide the reference voltage Vset to the pixel 111 and may measure a characteristic of the pixel 111 (e.g., a driving current flow through the organic light emitting diode EL, or impedance of the organic light emitting diode EL) according to the reference voltage Vset.

Figure 6:
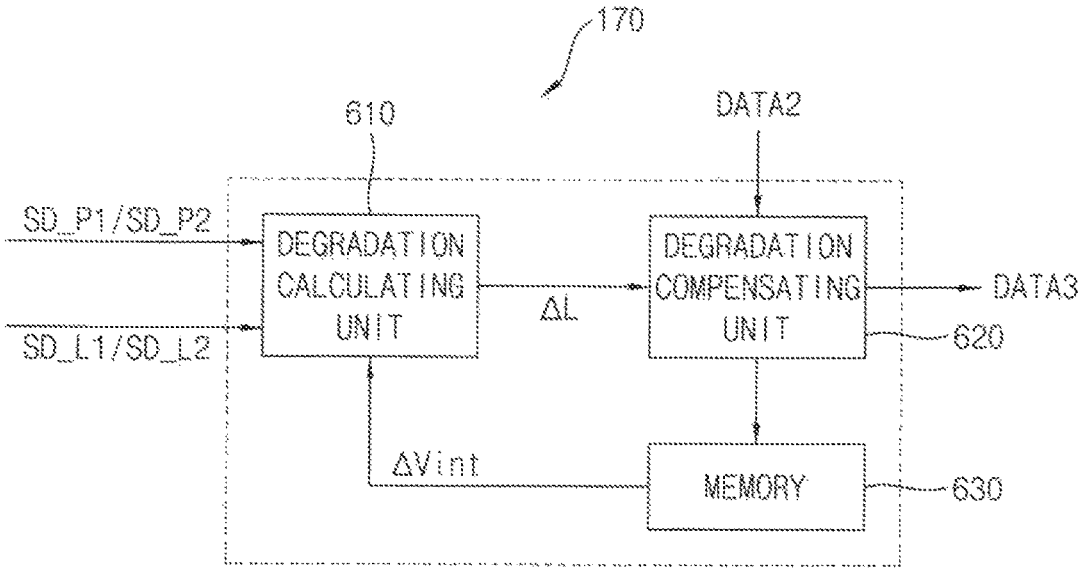
FIG. 6 is a block diagram illustrating an example of a data compensator included in the display device of FIG. 1.

FIG. 6 is a block diagram illustrating an example of a data compensator included in the display device of FIG. 1.

Referring to FIGS. 1, 3A, and 6, the data compensator 170 may include a degradation calculating unit (e.g., a degradation calculator) 610 and a degradation compensating unit (e.g., a degradation compensator) 620. In some example embodiments, the data compensator 170 may further include a memory device 630.

The degradation calculating unit 610 may generate a degradation compensation model of the second pixel P2 based on a first characteristic of the first pixel P1 and a second characteristic of the second pixel P2. For example, in a manufacturing process of the display device 100, the degradation calculating unit 610 may derive a linear equation, which represents a relation between a current variation (or, an amount of a current variation) and a luminance variation (or, a brightness variation), based on a first measured current SD_P1 of the first pixel P1, a first measure luminance SD_L1 of the first pixel P1, a second measured current SD_P2 of the second pixel P2, and a second measured luminance SD_L2 of the second pixel P2. Here, the current variation may be a current difference between the second measured current SD_P2 of the second pixel P2 and the first measured current P1 of the first pixel P1, and the luminance variation may be a luminance difference between the second measured luminance SD_L2 of the second pixel P2 and the first measured luminance SD_L1 of the first pixel P1. The second measured luminance SD_L2 and the first measured luminance SD_L1 may be provided from a luminance measuring device to the display device 100.

For example, the linear equation may be expressed by the [Equation 1] below, $$\Delta L=(SD_L2-SD_L1)=a*(SD_P2-SD_P1)+b \qquad \text{Equation 1}$$

where ΔL denotes a luminance variation, ΔI denotes a current variation, a denotes a constant, and b denotes a constant.

The degradation compensation model that is generated (or, the linear equation that is calculated) may be stored in the memory device 630.

In some example embodiments, the degradation calculating unit 610 may calculate an initial characteristic difference of the second pixel P2 based on a second characteristic of the second pixel P2 and a first characteristic of the first pixel P1 that are measured in an initial driving period of the display device 100. Here, the initial characteristic difference may be substantially the same as an initial characteristic difference Vint described with reference to FIG. 4. For example, the degradation calculating unit 610 may calculate an initial current difference between the second measured current SD_P2 of the second pixel P2 and the first measured current SD_P1 of the first pixel P1 that are measured in an initial driving period of the display device 100. The initial characteristic difference (or, an initial current difference) that is calculated may be stored in the memory device 630.

The degradation calculating unit 610 may calculate a characteristic difference between the second characteristic of the second pixel P2 and the first characteristic of the first pixel P1 and may calculate a degradation amount of the second pixel P2 based on the characteristic difference. For example, during a normal driving period of the display device 100, the degradation calculating unit 610 may calculate a current difference between the second measured current SD_P2 of the second pixel P2 and the first measured current SD_P1 of the first pixel P1, and may calculate an amount ΔL of degradation of the second pixel P2 based on the current difference.

In some example embodiments, the degradation calculating unit 610 may compensate for the characteristic difference based on the initial characteristic difference Vint stored in the memory device 630 and may calculate a degradation amount ΔL of the second pixel P2 using the degradation compensation model stored in the memory device 630. For example, the degradation calculating unit 610 may compensate for a current difference by summing (or, subtracting) the initial characteristic difference (e.g., an initial current difference) with the current difference, and may calculate a luminance variation (e.g., the degradation amount ΔL) corresponding to compensated current difference using the linear equation (i.e., the linear equation that represents a relation between a current variation and a luminance variation).

The degradation compensating unit 620 may compensate input data based on the degradation amount ΔL. For example, the degradation compensating unit 620 may obtain compensation data corresponding to the degradation amount ΔL using a look-up table and may generate compensated input data (e.g., third data DATA3) by adding (or, summing) the input data (e.g., second data DATA2) with the compensation data, where the look-up table may include the compensation data corresponding to the degradation amount ΔL and may be pre-stored in the memory device 630.

As described above, the data compensator 170 may calculate the degradation compensation model of the second pixel P2 and the initial characteristic difference based on the first characteristic of the first pixel P1 and the second characteristic of the second pixel P2 during a manufacturing process (or, an initial driving period) of the display device 100. In addition, the data compensator 170 may calculate the degradation amount ΔL of the second pixel P2 based on the first characteristic of the first pixel P1, the second characteristic of the second pixel P2, the degradation compensation model, which is pre-calculated (and pre-stored), and the initial characteristic difference Vint. Similarly, the data compensator 170 may calculate a degradation amount of each of the third through ninth pixels P3 through P9 illustrated in FIG. 3A and pixels included in the display panel 110.

Figure 7:
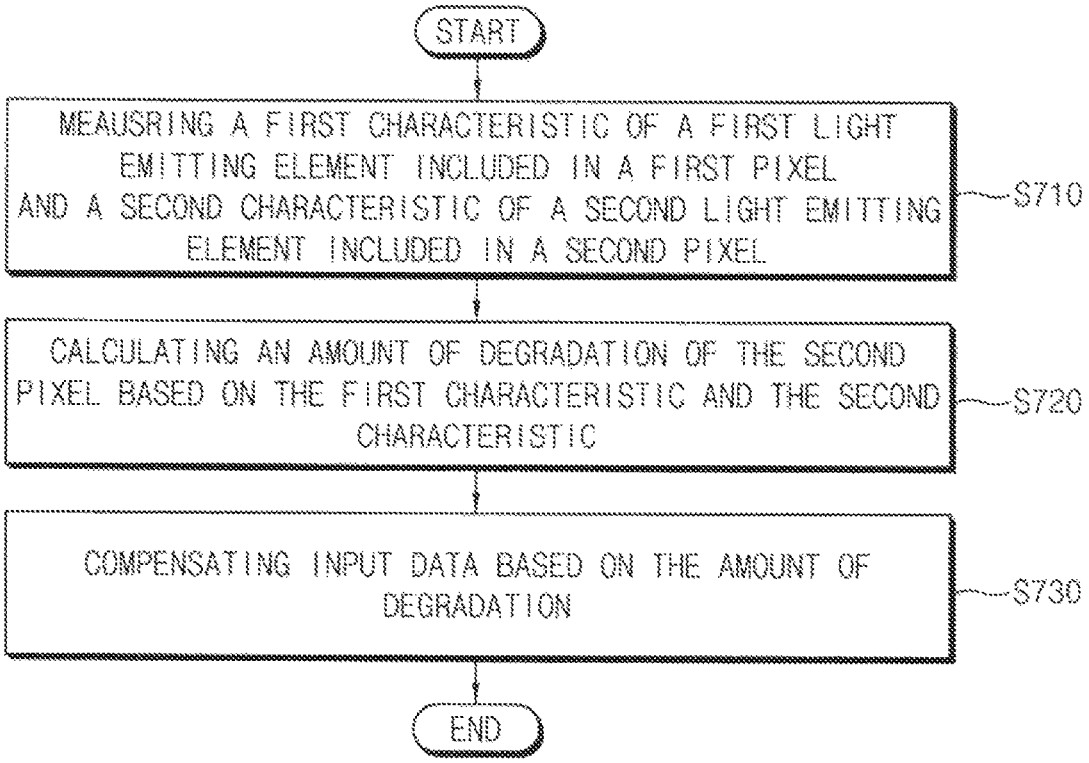
FIG. 7 is a flow diagram illustrating a method of compensating for pixel degradation of a display device according to some example embodiments of the present invention.

FIG. 7 is a flow diagram illustrating a method of compensating pixel degradation of a display device according to some example embodiments of the present invention.

Referring to FIGS. 1, 3A, and 7, the method of FIG. 7 may be performed by the display device 100 of FIG. 1.

The method of FIG. 7 may respectively measure a first characteristic of a first light emitting element included in the first pixel P1 and a second characteristic of a second light emitting element included in the second pixel P2 (S710). Here, the first pixel P1 may emit light with the first luminance that is lower than the target luminance, and the second pixel P2 may emit light with the second luminance that is higher than the target luminance. As described above, the second pixel P2 may be spaced adjacent to the first pixel P1 and may compensate for a luminance deficiency (e.g., a luminance difference between the target luminance and the first luminance) by emitting light with the second luminance.

As described with reference to FIGS. 3B and 3C, the method of FIG. 7 may emit the first pixel P1 with the first luminance by using a first gamma voltage generating unit, by using a first light emission control signal, or by using data conversion. The method of FIG. 7 may emit the first pixel P1 with the first luminance in a normal driving period of the display device 100 by accelerating degradation of the first pixel P1 (or, aging the first pixel P1) in a manufacturing process of the display device 100.

The method of FIG. 7 may calculate a degradation amount of the second pixel P2 (or, the second light emitting element) based on the first characteristic of the first light emitting element and the second characteristic of the second light emitting element (S720). For example, the method of FIG. 7 may calculate the degradation amount of the second pixel P2 based on the [Equation 1].

The method of FIG. 7 may compensate input data based on the degradation amount (S730). For example, the method of FIG. 7 may obtain compensation data corresponding to the degradation amount using a look-up table and may generate compensated input data by summing the input data to the compensation data.

Figure 8:
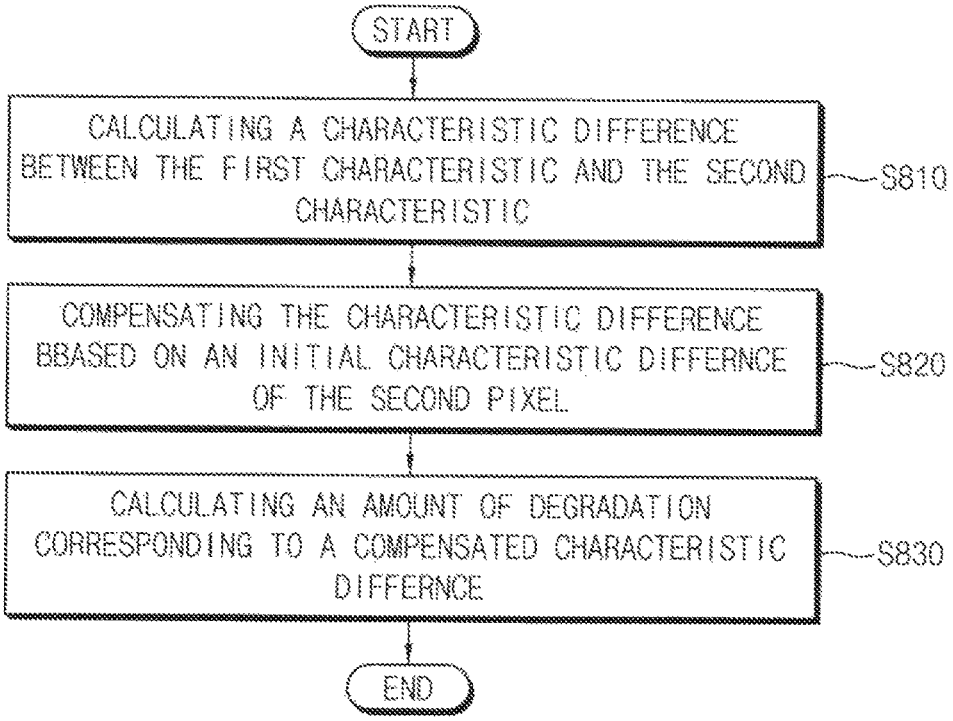
FIG. 8 is a flow diagram illustrating an example in which a degradation amount is calculated by the method of FIG. 7.

FIG. 8 is a flow diagram illustrating an example in which a degradation amount is calculated by the method of FIG. 7.

Referring to FIGS. 7 and 8, the method of FIG. 8 may calculate a characteristic difference between the first characteristic of the first light emitting element and the second characteristic of the second light emitting element (S810), may compensate for the characteristic difference based on an initial characteristic difference of the second pixel P2 (or, the second light emitting element), which is pre-stored (S820), and may calculate a degradation amount corresponding to a compensated characteristic difference using a linear equation. Here, the linear equation may represent a relation between the characteristic difference of the second pixel P2 (or, the second light emitting element) and the degradation amount as described above. For example, the linear equation may be expressed by the [Equation 1].

As described with reference to FIGS. 7 and 8, the method of compensating pixel degradation of a display device according to some example embodiments may calculate the amount (e.g., a relative amount) of degradation of the second pixel P2, which is adjacent to the first pixel P1, based on the first pixel P1, which emits light with first luminance that is lower than the target luminance. That is, the method of FIG. 7 may improve accuracy of compensating for degradation of the second pixel P2 by calculating a relative degradation amount of the second pixel P2 by using the first pixel P1 adjacent to the second pixel P2. In addition, the method of FIG. 7 may compensate for a luminance deficiency (i.e., a luminance difference between the target luminance and the first luminance) by the second pixel P2 emitting light with the second luminance, which is higher than the target luminance. That is, the method of FIG. 7 may prevent the first pixel P1 from being shown or readily visible to a user.

Figure 9:
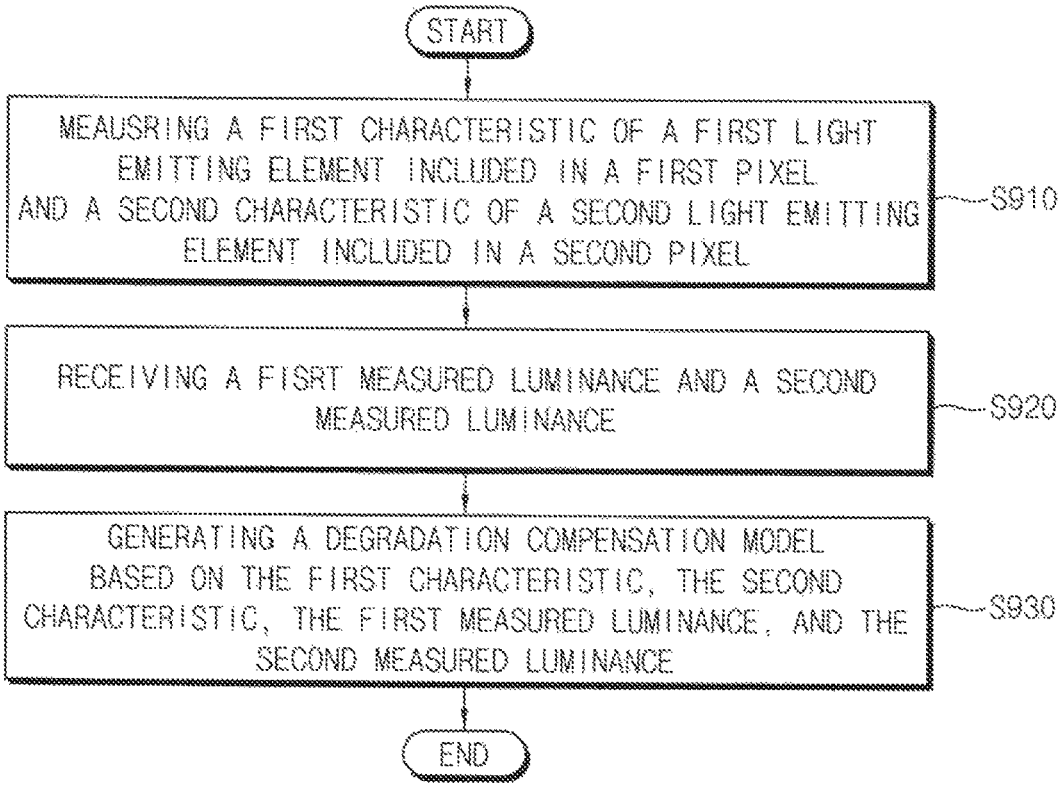
FIG. 9 is a flow diagram illustrating a method of compensating for pixel degradation of a display device according to some example embodiments of the present invention.

FIG. 9 is a flow diagram illustrating a method of compensating pixel degradation of a display device according to some example embodiments of the present invention.

Referring to FIGS. 1, 3A, and 9, the method of FIG. 9 may be performed by the display device 100 of FIG. 1 and may be performed in a step of measuring the first characteristic and the second characteristic in the method of FIG. 7.

The method of FIG. 9 may respectively measure a first characteristic of the first light emitting element included in the first pixel P1 and a second characteristic of the second light emitting element included in the second pixel P2 (S910).

The method of FIG. 9 may receive the first measured luminance SD_L1 of the first pixel P1 and the second measured luminance SD_L2 of the second pixel P2 that are measured by a luminance measuring device (S920). Here, the luminance measuring device may be provided on the outer of the display device 100 and may measure luminance of the display panel 110 (or, pixels P1 and P2).

The method of FIG. 9 may generate a degradation compensation model based on the first characteristic of the first pixel P1 and the second characteristic of the second pixel P2 (S930). For example, the method of FIG. 9 may derive (or, obtain) a linear equation, which represents a relation between a current variation and a luminance variation, based on the first measured current SD_P1 of the first pixel P1, the first measured luminance SD_L1 of the first pixel P1, the second measured current SD_P2 of the second pixel P2, and the second measured luminance SD_L2. Here, the linear equation may be expressed by the [Equation 1] as described above.

In some example embodiments, the method of FIG. 9 may calculate an initial characteristic difference of the second pixel P2 based on the second characteristic of the second pixel P2 and the first characteristic of the first pixel P1. Here, the initial characteristic difference may be substantially the same as the initial characteristic difference Vint described with reference to FIG. 4. For example, the method of FIG. 9 may calculate an initial current difference between the first measured current SD_P1 of the first pixel P1 and the second measured current SD_P2 of the second pixel P2 during an initial driving period of the display device 100. Here, the initial characteristic difference (or, the initial current difference) of the second pixel P2 may be stored in the memory device 630.

As described above, the method of FIG. 9 may calculate the degradation compensation model and the initial characteristic difference of the second pixel P2. Therefore, the method of FIG. 9 may calculate a relative degradation amount of the second pixel P2 based on the degradation compensation model and the initial characteristic difference, and may compensate for degradation of the second pixel P2 based on the degradation amount.

The present inventive concept may be applied to any electronic devices including a display device. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

It will be understood that when an element or layer is referred to as being "connected to" or "adjacent" another element, it can be directly connected to or adjacent the other element or layer, or one or more intervening elements may be present. When an element is referred to as being "directly connected to", or "immediately adjacent" another element, there are no intervening elements present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein, such as the scan driver, the data driver, the emission driver, the sensor, the timing controller, and the data compensator, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the example embodiments of the present invention.

The foregoing is illustrative of some example embodiments, and is not to be construed as limiting thereof. Although a few example embodiments have been described, those skilled in the art will readily appreciate that many suitable modifications are possible in the example embodiments without materially departing from the novel teachings of the example embodiments. Accordingly, all such modifications are intended to be included within the scope of the present invention as defined by the claims, and equivalents thereof. In the claims, means-plus-function clauses are intended to cover the structures described herein as performing the recited function and also equivalent structures. Therefore, it is to be understood that the foregoing is illustrative of some example embodiments and is not to be construed as limited to the specific embodiments disclosed, and that modifications to the disclosed example embodiments, as well as other example embodiments, are intended to be included within the scope of the appended claims and their equivalents.

What is claimed is:

1. A method of compensating for pixel degradation of a display device that comprises a first pixel that emits light with a first luminance that is lower than a target luminance and a second pixel that emits light with a second luminance that is higher than the target luminance, the method comprising:

measuring a first characteristic of a first light emitting element comprised in the first pixel and a second characteristic of a second light emitting element comprised in the second pixel;

receiving a first measured luminance corresponding to the first characteristic and a second measured luminance corresponding to the second characteristic from an external component; and generating a degradation compensation model based on the first characteristic, the second characteristic, the first measured luminance, and the second measured luminance, wherein the degradation compensation model represents a relation between a characteristic variation and a luminance variation, the characteristic variation being a characteristic difference between the first characteristic and the second characteristic, and the luminance variation being a luminance difference between the first measured luminance and the second measured luminance, and wherein the first pixel has a degradation rate lower than a degradation rate of the second pixel, and the second pixel comprises a plurality of pixels adjacent to and around the first pixel and is configured to compensate for a luminance deficiency of the first pixel by emitting light with the second luminance.

2. The method of claim 1, wherein generating the degradation compensation model comprises:

calculating an initial characteristic difference of the second pixel based on the first characteristic and the second characteristic; and storing the initial characteristic difference in a memory device.

* * * * *